United States Patent [19]

Eivola

[11] Patent Number: 4,996,782

[45] Date of Patent: Mar. 5, 1991

[54] NOZZLE ARRANGEMENT IN A BLOW BOX OR PIPE OF A PAPER MAKING MACHINE

[75] Inventor: Ilkka Eivola, Naantali, Finland

[73] Assignee: Valmet Paper Machinery Inc., Finland

[21] Appl. No.: 521,747

[22] Filed: May 10, 1990

[30] Foreign Application Priority Data

May 18, 1989 [FI] Finland ..... 892385

[51] Int. Cl.[5] ..... F26B 13/06

[52] U.S. Cl. ..... 34/114; 34/122; 34/117

[58] Field of Search ..... 34/117, 114, 122, 123, 34/120; 162/207, 289

[56] References Cited

U.S. PATENT DOCUMENTS

| | | | |
|---|---|---|---|
| 1,595,478 | 8/1926 | Minton | 34/117 |
| 4,502,231 | 3/1985 | Fissmann et al. | 34/114 |
| 4,539,762 | 9/1985 | Eskelinen et al. | 34/122 |
| 4,628,618 | 12/1986 | Virta et al. | 34/122 |
| 4,669,198 | 6/1987 | Wedel | 34/117 |
| 4,856,205 | 8/1989 | Meyer et al. | 34/117 |
| 4,893,741 | 1/1990 | Heinzmann | 34/117 |
| 4,899,463 | 2/1990 | Heikkilä et al. | 34/114 |

*Primary Examiner*—Henry A. Bennet
*Assistant Examiner*—Denise L. F. Gromada
*Attorney, Agent, or Firm*—Steinberg & Raskin

[57] ABSTRACT

A nozzle arrangement in a blow box of a paper machine, comprising one or several nozzles (22*a*, 22*b*) placed in connection with the blow box (20) or pipe, through which nozzles a blowing of air can be applied to a moving member in a paper machine placed in their proximity, such as a wire, drying cylinder, guide roll, felt, or the equivalent. The blow box (20) and its nozzles (20*a*, 20*b*) are at a certain operational safety distance (C) from the moving member. In connection with the nozzle slots of the nozzles (22*a*, 22*b*) or nozzle, a respective nozzle flap (24*a*, 24*b*) pivotable around a respective transverse hinge shaft (P) is hinged. The nozzle flaps (24*a*, 24*b*) respectively guide the blowing of air ($F_a$, $F_b$) to the desired object and if necessary maintain a required difference in pressure. The nozzle flaps (24*a*, 24*b*) are hinged in such a way that, in their normal operating position, the outer edge of the respective flap is at a distance considerably shorter than the required operational safety distance from the moving member (10, 12), but the nozzle flaps (24*a*, 24*b*) can pivot to the required safety distance when a paper clod or some other obstacle passes by.

8 Claims, 2 Drawing Sheets

NOZZLE ARRANGEMENT IN A BLOW BOX OR PIPE OF A PAPER MAKING MACHINE

BACKGROUND OF THE INVENTION

The invention concerns a nozzle arrangement in a blow box or any other, equivalent blow member in a paper making machine, comprising one or more nozzles placed in connection with a blow box or pipe, or equivalent member through which nozzles the blowing of air can be applied to a moving member in a paper machine placed in proximity to the nozzles, such as a wire, drying cylinder, guide roll, felt, or the equivalent, and which blow box and its nozzles are arranged at a certain operational safety distance from the moving member.

In the prior art, the multi-cylinder dryers of paper machines in common use consist of two lines of cylinders placed one above the other, in which connection an upper wire or felt as well as a lower wire or felt are used, which wires or felts are guided by guide rolls placed in the gaps between the drying cylinders so that these wires or felts press the web against the cylinder face. The web runs from one line of cylinders to the other in a series of free draws. Inside the multi-cylinder dryer, these free draws of the web, respective faces of the cylinders, and the wires or felts guided by the guide rolls define pockets, which are open at their ends but otherwise closed, the ventilation of these pockets being an important factor with a view to achieving uniformity of drying efficiency and drying results in a multi-cylinder dryer.

In recent years, the running speeds of paper machines have been increasing, and this has had the consequence that these free draws of the paper web have been made shorter particularly in order to reduce the risk of web breaks resulting from fluttering. However, it follows that the above-mentioned ventilation of the pockets has become more difficult, because the size of the pockets has become smaller. Moreover, constantly increasing requirements are imposed for the ventilation of the pockets, because the dwell times of the web in direct connection with the pockets have also become shorter.

In the prior art, a number of different blow devices are known, by whose means air is blown through the felts or wires into the pockets or to other objects.

When disturbances in operation occur, paper waste is produced in paper making machines, which waste frequently forms clods which cause problems in congested locations in the machine, e.g. in the narrow gaps between the blow boxes and wires, drying cylinders or guide rolls. This is why relatively large safety distances are required between the wires or the web and the blow boxes in order that these clods can pass between the blow boxes and the above-mentioned parts without causing damage to their structures. These safety distances are generally in the order of 50 to 100 mm.

Since the air nozzles of the blow boxes must be placed at the aforementioned safety distance, e.g., from a wire, frequently the desired effects of the blowings are not completely achieved, because, for example, the blowing cannot be directed precisely at its target and sufficiently high pressure cannot be achieved by means of the blowings. A typical example of devices wherein drawbacks of the sort discussed above are present are the pocket ventilation pipes described in the Applicant's FI Patent No. 68,278 (corresp. U.S. Pat. No. 4,539,762), which pipes, placed at a distance of, e.g., 100 mm from the wire, do not produce a sufficiently large quantity of air passing through the wire to ensure adequate pocket ventilation.

SUMMARY OF THE INVENTION

The principal object of the present invention is to provide a novel nozzle arrangement, comprising a type of safety nozzle, for the blow box, by whose means the blowing coming from the safety nozzle can be directed sufficiently precisely and, if necessary, sufficiently large differences in pressure can be produced while, nevertheless, at the same time, retaining the operational safety of the structural elements of the paper machine so that paper clods can be removed through the gaps placed facing the safety nozzles.

With a view to achieving the objectives given above and those that will be stated hereinafter, the invention is mainly characterized in that in connection with the nozzle slots of said nozzles or nozzle, a nozzle flap or flaps pivotable around a transverse hinge shaft is or are hinged, that this nozzle flap or flaps is or are arranged to guide the blowing of air to the desired object and possibly to maintain a required difference in pressure, and that these nozzle flaps or flap are or is hinged in such a way that, in the operating position, the outer edge of the flap is at a distance considerably shorter than the required operational safety distance from the moving machine member, as well as so that these nozzle flaps or flap can pivot to the required safety distance when a paper clod or a corresponding obstacle passes by.

BRIEF DESCRIPTION OF THE DRAWINGS

In the following, the invention will be described in detail with reference to a preferred embodiment thereof shown in the Figures in the accompanying drawing, the invention being not confined to the details of this preferred embodiment.

DESCRIPTION OF THE PREFERRED EMBODIMENTS

Figure 1:
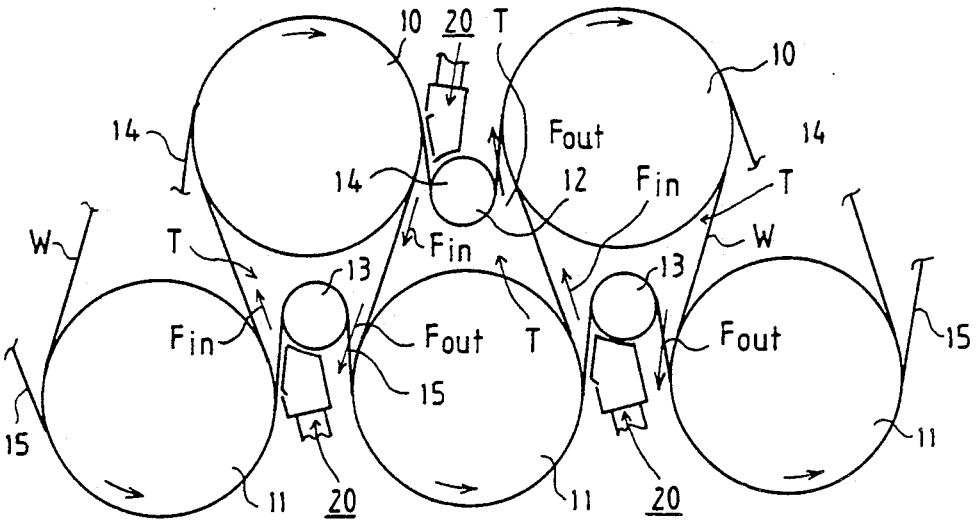
FIG. 1 is a schematical side view of part of a multi-cylinder dryer, wherein pocket ventilation devices in accordance with a preferred embodiment of the invention are applied.

As is shown in FIG. 1, the multi-cylinder dryer consists of a line of upper cylinders 10 and of a line of lower cylinders 11. The upper cylinders 10 and the lower cylinders 11 are placed so as to be interlocked with each other, and between them there are the felt guide rolls 12 and 13. The upper guide rolls 12 guide the upper wire 14, and the lower guide rolls 13 guide the lower wire 15, respectively. The web W runs in a meandering manner from the upper cylinder onto the next lower cylinder and the other way around. The upper wire 14 and the lower wire 15, respectively, press the web W against the heated outer faces of the drying cylinders 10 and 11. Between the cylinders 10, 11, the web W has free unsupported runs $W_1$.

The heated faces of the drying cylinders 10 and 11, the wires 14, 15 which run over the guide rolls 12, 13, and the unsupported runs $W_1$ of the web W define pockets T between them, which pockets must be ventilated so as to remove the water evaporated from the web W. For the purpose of providing for this ventilation, pocket ventilation devices 20 have been arranged against the upper and the lower wire 14, 15, a detailed exemplifying embodiment of the construction of these devices being shown in FIGS. 2 and 3. The pocket ventilation devices 20 are placed on the respective runs of the wires 14, 15 between the drying cylinders 10, 11 and the guide rolls 12, 13. In the direction of running of the wires 14, 15, the pocket ventilation devices 20 are placed on the inlet-side runs of the wires, whereas the subsequent outlet-side runs of the wires 14, 15 remain free and are unaffected by the pocket ventilation devices.

In the structure discussed heretofore, an upper wire 14 and a lower wire 15 have been recited. As an alternative, instead of wires 14, 15, it is possible to use felts or the equivalent made of fabrics whose permeability to air and other properties are suitable for the objects of the invention.

By means of the pocket ventilation devices 20, air is introduced through the wires 14, 15 into the pockets T in the direction of the arrow $F_{in}$, and this blow-in air is removed from the pockets partly at the outlet side of the wires 14, 15 in the direction of the arrows $F_{out}$ and partly through the ends of the pockets T.

The constructions described above are known in the prior art, and they are described here in order to illustrate the field of application of the invention only.

In the following, referring to FIG. 2, an exemplifying embodiment of the construction of a pocket ventilation device 20 provided with a nozzle arrangement in accordance with the invention will be described.

Figure 2:
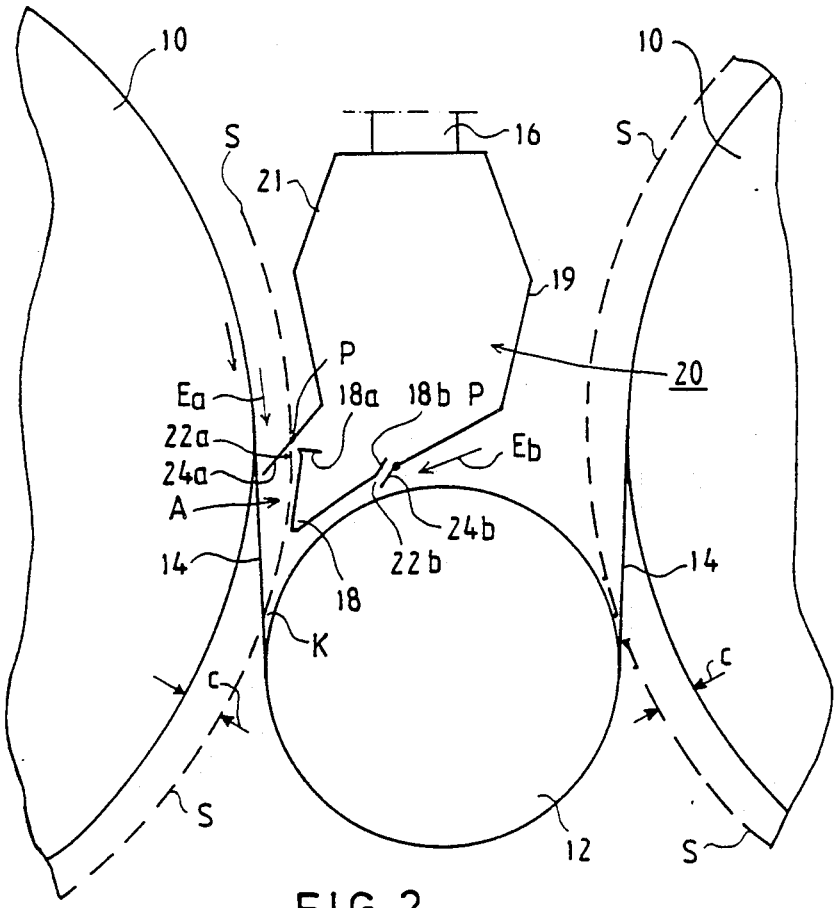
FIG. 2 is a vertical sectional view in the machine direction of a nozzle arrangement in accordance with this preferred embodiment of the invention on an enlarged scale as compared with FIG. 1.

The pocket ventilation device 20 of FIG. 2 is placed substantially in a narrowing gap or wedge-shaped space between the guide roll 12, and the wire 14. The pocket ventilation device 20 comprises a box-like construction into which the air is introduced by means of an inlet pipe 16. This ventilation device comprises walls 19 and 21 that extend in the machine's transverse direction as well as of planar ends (not shown). The ventilation device also comprises a nozzle nose 18, whose edges **18*a* and 18*b* define the blow nozzles 22*a* and 22*b* together with the edge portions of the walls 19 and 21**.

From the interior of the box-like construction, through the nozzles **22*a* and 22*b*, air is blown into the space A and gap K defined by the wire 14, by the guide roll 12, and by the nozzle nose 18. The nozzle nose 18 is partly shaped so to conform to the shape of the gap K formed by the wire 14 and by the guide roll 12. The edges 18*a* and 18*b* of the nozzle nose are shaped so that the jet coming out of the nozzle 22 is directed substantially towards the bottom of the gap K and that the jet coming out of the nozzle 22*b* is substantially parallel to an imaginary tangential plane of the guide roll 12. As a result of the blowing taking place through the nozzles 22*a*, 22*b*** and as a result of the suction effect occurring in the directions of the arrows $E_a$ and $E_b$, a relatively large positive pressure is formed in the area A, by the effect of which pressure the blow air is carried through the wire and produces ventilation of the pockets T.

Figure 3:
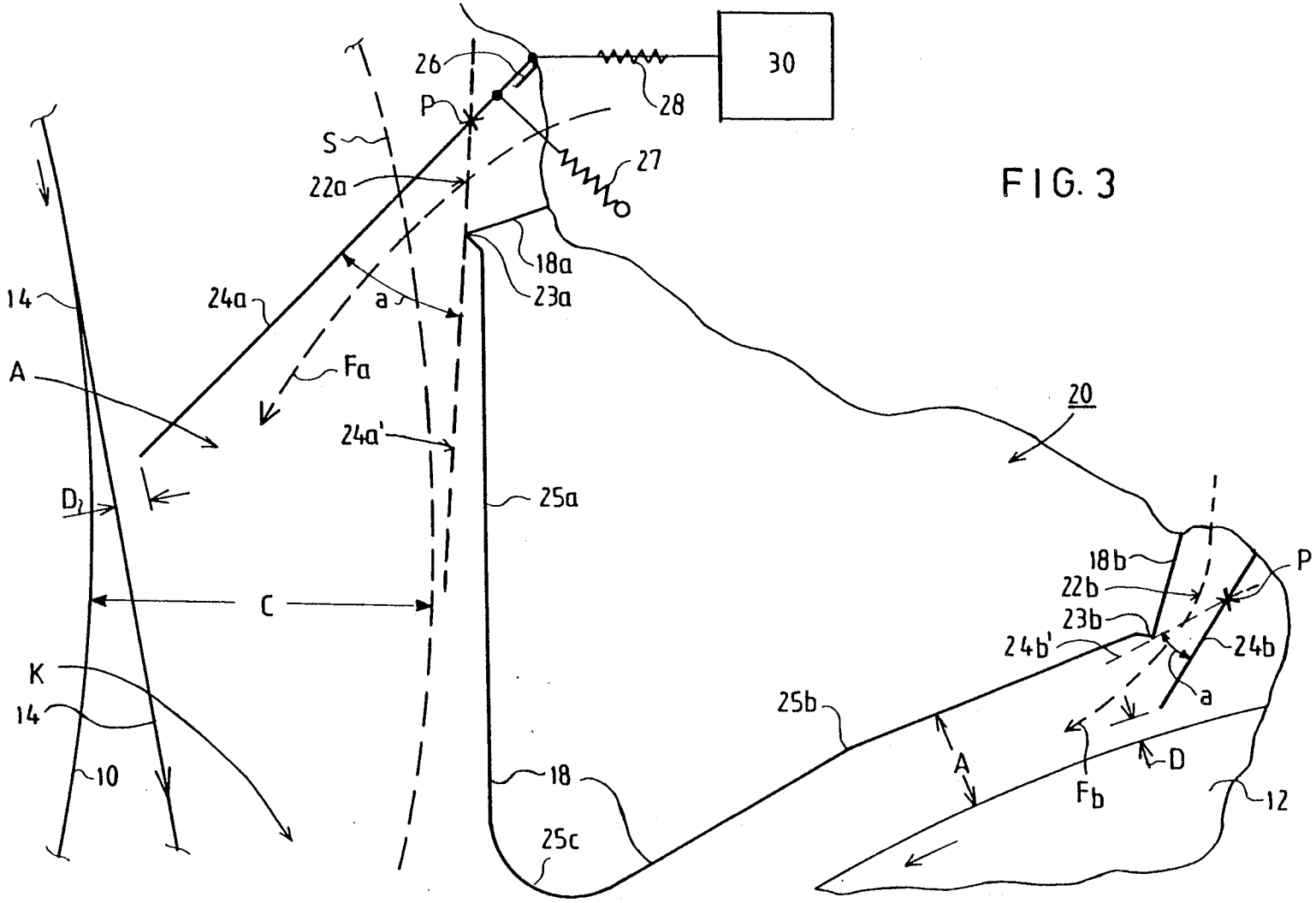
FIG. 3 shows a more detailed construction and dimensioning of the nozzle arrangement on an enlarged scale as compared with FIG. 2.

According to the present invention and with particular reference to FIG. 3, pivotable nozzle flaps **24*a*, 24*b* are provided in connection with the nozzle slots 22*a* and 22*b* by means of horizontal pivot shafts P transverse to the machine direction in connection with the wall construction of the blow box 20. The nozzle flaps 24*a* and 24*b* can pivot within a sector a, which is determined by the edge part 23*a*, 23*b* of the nozzle slots 22*a*, 22*b* on one hand, and by a limiter element 26, which is attached to the wall constructions of the blow box 20 and which is shown schematically in FIG. 3. The nozzle flaps 24*a* and 24*b* form an extension of the nozzle and a guide for the air blown out of the nozzle box 20, so that the blowings $F_a$, $F_b$ coming out of the nozzles 22*a*, 22*b* are respectively directed against the wire 14, and tangentially to the nozzle face placed facing the guide roll such that, because of the nozzle flaps 24*a*, 24*b*, a sufficiently high pressure, in view of the necessary pocket ventilation, can be created in the area A and in the gap K. The other extreme position of the nozzle flaps 24*a* and 24*b* is denoted with dashed lines and with the reference numerals 24*a* and 24*b*, the nozzle flaps 24 being pivoted into these positions when a paper clod passes by the side faces 25*a* and 25*b* of the tip 25*c* of the nozzle nose. In such a case, sufficiently large safety distances C and A are formed respectively between the cylinder 10 face and the guide-roll 12 face and the faces 25*a* and 25*b* of the nozzle nose 18**.

In FIGS. 2 and 3, the safety distance C from the drying cylinder 10 is denoted with the arc S. In the invention, this safety distance C can be kept sufficiently large, e.g. C=100 mm, and the safety distance A between the guide roll 12 and the face **26*b* placed facing the blow box 20 may be, e.g., A=15 . . . 20 mm, and, at the same time, the distance D of the outer edges of the nozzle flaps 24*a* and 24*b* from the wire 11 and from the face of the guide roll 12 can be made very small, e.g., D=3 . . . 15 mm. When it is possible to use such a small "real" safety distance D, the nozzles of the nozzle box 20** can be made to operate in the intended way while, nevertheless, maintaining the "operational" safety distance C.

In FIG. 3, a spring 27 acting as a counter-force to gravity and/or the blowing passing through the nozzle **22*a* turn the nozzle flap 24*a* to the open position so that it is just a small distance D from the wire 14 placed facing it. When the blowing is discontinued or when a paper clod passes between the cylinder and the wire 14 or between the wire and the blow box, the flap 24*a* pivots against the blowing and by the effect of gravity to the position 24*a*'. In the corresponding way, the flap 24*b* of the nozzle 22*b* is, by the effect of gravity, in the open position, and the flap 24*b* pivots into the closed position 24*b*' when a paper clod passes by. The nozzle flaps 24*a* and 24*b*** are intentionally hinged such that they open in a "downstream" direction in relation to the direction of movement of a paper clod when a paper clod or the equivalent passes by.

If necessary, a spring device can also be arranged in connection with the nozzle flaps **24*a*, 24*b*, this spring device functioning to pivot the nozzles to the open position after a paper clod has bypassed them. The edges 18*a*, 18*b* of the nozzle are shaped so that the air flows $F_a$ and $F_b$ respectively follow the guide edges provided by the nozzle flaps 24*a* and 24*b***.

The invention can also be practiced such that, in the paper making machine's transverse direction, several nozzle flaps are used which are placed side by side directly edge to edge and each of which is connected to an actuator, which is, in FIG. 3, illustrated schematically as block 30. The connections of the nozzle flaps to the actuator 30 are arranged, e.g., by means of springs 28 or in any other way such that the nozzle flaps can pivot to the by passing positions **24*a*', 24*b*' when a paper clod or any other obstacle passes by. By means of this actuator, it is possible to accomplish so-called sectional regulation, wherein it is possible to close at least some of a plurality of flaps 24a, 24b in order to control the transverse distribution of the air quantity blown through the nozzles 22a, 22b**, and thereby it is possible to regulate the transverse moisture profile of the paper web W.

Even though the invention has been hereto described with reference to blow boxes or pipes for pocket ventilation in a multi-cylinder dryer, the nozzle arrangement in accordance with the invention may also be used in other locations where relatively large safety distances are required but where these relatively large safety distances affect operation of the nozzles.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. A nozzle arrangement for a blow box or pipe or equivalent blow element in a paper making machine; said nozzle arrangement comprising;

one or more nozzles, each of said one or more nozzles being integral with said blow box or pipe or equivalent blow element, and each of said one or more nozzles comprising a stationary edge member and a movable flap member which together with said stationary edge member defines a space through which a blow gas can pass from said blow box or pipe or equivalent element to impinge upon a desired member within said paper making machine; and a hinge shaft whose longitudinal axis is substantially transverse to the path of a paper or paperboard web passing through said paper making machine, said movable flap member connected at one end, to said hinge and being pivotable about said longitudinal axis such that said movable flap member can move from a first position wherein an edge thereof at another end thereof opposite said one end is within a predetermined safety distance from said desired member, to another position wherein said edge thereof is beyond said predetermined safety distance from said desired member when a paper clod or other obstacle passes by said each of said one or more nozzles.

2. The nozzle arrangement of claim 1, wherein said stationary edge member is configured such that said blow gas flows from said each of said one or more nozzles in a direction substantially conforming to the configuration of said movable flap.

3. The nozzle arrangement of claim 1, wherein said nozzle flap remains in said first position by the effect of gravity.

4. The nozzle arrangement of claim 1, wherein said nozzle flap remains in said first position by the effect of said blow gas passing therethrough.

5. The nozzle arrangement of claim 1, further comprising a spring connected to said nozzle flap for maintaining said nozzle flap in said first position.

6. The nozzle arrangement of claim 1, wherein said equivalent blow element in a paper making machine is a pocket ventilation device located in a multi-cylinder dryer of said paper machine, and said multi-cylinder dryer comprises a plurality of drying cylinders, a guide roll located in a gap between two adjoining said drying cylinders, a drying wire having a free run within said paper machine so as to abut said adjoining drying cylinders and said guide roll and said nozzle arrangement comprises a first of said one or more nozzles located so as to direct said blow gas onto a surface of said drying wire opposite to another surface of said drying wire which abuts one of said adjoining drying cylinders and said movable flap of said one nozzle moves from said first position in a direction which is downstream relative to the running direction of said drying wire.

7. The nozzle arrangement of claim 6, further comprising a second of said one or more nozzles located such that its movable flap in its said first position has its edge at said end opposite said end connected to said hinge shaft within a predetermined safety distance from said guide roll.

8. The nozzle arrangement of claim 1, further comprising an actuator and wherein said nozzle arrangement has a plurality of said one or more nozzles placed adjacent to each other, said actuator functioning to move said movable flaps of each of said plurality of nozzles in a manner so as to control the transverse moisture profile or other properties of said paper or paperboard web passing through said machine.

* * * * *